US006687483B2

(12) United States Patent
Chen et al.

(10) Patent No.: US 6,687,483 B2
(45) Date of Patent: Feb. 3, 2004

(54) FUSER APPARATUS FOR ADJUSTING GLOSS OF A FUSED TONER IMAGE AND METHOD FOR FUSING A TONER IMAGE TO A RECEIVER

(75) Inventors: Jiann-Hsing Chen, Fairport, NY (US); Andrew Ciaschi, Lima, NY (US); Joseph A. Pavlisko, Pittsford, NY (US); Robert A. Lancaster, Hilton, NY (US)

(73) Assignee: NexPress Solutions LLC, Rochester, NY (US)

( * ) Notice: Subject to any disclaimer, the term of this patent is extended or adjusted under 35 U.S.C. 154(b) by 19 days.

(21) Appl. No.: 10/158,604

(22) Filed: May 30, 2002

(65) Prior Publication Data

US 2003/0223792 A1 Dec. 4, 2003

(51) Int. Cl.[7] ..... G03G 15/20
(52) U.S. Cl. ..... 399/341
(58) Field of Search ..... 399/341; 219/216

(56) References Cited

U.S. PATENT DOCUMENTS

| | | | | | |
|---|---|---|---|---|---|
| 5,177,550 | A | * | 1/1993 | Uehara et al. | 399/341 |
| 6,007,918 | A | * | 12/1999 | Tan et al. | 428/451 |
| 6,103,815 | A | * | 8/2000 | Mammino et al. | 524/546 |
| 6,159,588 | A | * | 12/2000 | Eddy et al. | 428/215 |
| 6,272,310 | B1 | * | 8/2001 | Blair et al. | 399/341 |
| 6,355,352 | B1 | * | 3/2002 | Chen et al. | 428/421 |
| 6,361,829 | B1 | * | 3/2002 | Chen et al. | 427/380 |
| 6,372,833 | B1 | * | 4/2002 | Chen et al. | 524/409 |
| 6,429,249 | B1 | * | 8/2002 | Chen et al. | 524/432 |
| 6,444,741 | B1 | * | 9/2002 | Chen et al. | 524/428 |
| 2003/0059619 | A1 | * | 3/2003 | Chen et al. | 428/421 |

* cited by examiner

*Primary Examiner*—Quana M. Grainger

(57) ABSTRACT

Disclosed are apparatus and methods to adjust gloss of a fused toner image, and in particular to reduce differential gloss within the fused toner image so as to provide prints which more closely resemble lithographic prints in image quality. In embodiments, the apparatus and methods employ a finishing member having an outer contact surface thereon which contacts a previously fused toner image under conditions of elevated temperature and pressure. The contact surface is comprised of a fluorocarbon thermoplastic random copolymer co-cured with a fluorinated resin, such as polyfluoroethylenepropylene (FEP). In embodiments, the contact surface comprises a fluorocarbon thermoplastic random copolymer co-cured with a fluorinated resin including subunits of:

$$-(CH_2CF_2)x-,\ -(CF_2CF(CF_3))y-,\ \text{and}\ -(CF_2CF_2)z-,$$

wherein:

x is from 1 to 50 or 60 to 80 mole percent, y is from 10 to 90 mole percent, z is from 10 to 90 mole percent, and x +y+z equals 100 mole percent.

61 Claims, 5 Drawing Sheets

FUSER APPARATUS FOR ADJUSTING GLOSS OF A FUSED TONER IMAGE AND METHOD FOR FUSING A TONER IMAGE TO A RECEIVER

CROSS REFERENCE TO RELATED APPLICATIONS

U.S. patent application Ser. No. 10/158,601, filed concurrently on even date herewith and entitled "Fuser Member With Tunable Gloss Level And Methods And Apparatus For Using The Same To Fuse Toner Images", is a related application, the teachings of which are incorporated herein by reference in their entirety.

Attention is also directed to the following U.S. patent application Ser. Nos. 09/609,561; 09/607,731; 09/608,290; and 09/697,418 filed on Jun. 30, 2000 relating to cured fluorocarbon thermoplastic copolymer compositions, and U.S. patent application Ser. Nos. 09/609,562; 09/608,289; 09/608,362; and 09/608,818 also filed on Jun. 30, 2000, relating to catalysts and low-temperature cure fluorocarbon thermoplastic copolymer compositions. The teachings of each of the above-described applications are also incorporated herein by reference in their entirety.

FIELD OF THE INVENTION

This invention relates to methods and apparatus for fixing toner particles to a receiver in an electrostatographic apparatus. More particularly, this invention relates to methods and apparatus for fusing toner particles to a receiver to provide a fused toner image with desirable gloss characteristics.

BACKGRIUND OF THE INVENTION

Heat-softenable toners are widely used in imaging methods such as electrostatography, wherein electrically charged toner particles are deposited imagewise on a dielectric or photoconductive element bearing an electrostatic latent image. Most often in such methods, the toner is then transferred to a surface of another substrate, such as, e.g., a receiver sheet comprising paper or a transparent film, where it is then fixed in place to yield a final desired toner image.

When heat-softenable toners, comprising for example thermoplastic polymeric binders, are employed, the usual method of fixing the toner in place involves applying heat to the toner once it is on the receiver sheet surface to soften it, and then allowing or causing the toner to cool.

One such fusing method comprises passing the toner-bearing receiver sheet through a nip formed by a pair of opposing members, typically in the form of cylindrical rollers, wherein at least one of the members (usually referred to as a fuser member) is heated and contacts the toner-bearing surface of the receiver sheet in order to heat and soften the toner. The other member (usually referred to as a pressure member) serves to press the receiver sheet into contact with the fuser member. In some other fusing methods, the configuration is varied and the "fuser member" or "pressure member" can take the form of a flat plate or belt.

The desired gloss of the fused electrostatographic images can vary depending on the thermoplastic binder used for the toner, the materials used for the surfaces of the fuser and/or pressure members, and conditions employed during the fusing step as mentioned briefly hereinafter. Typically, it is preferred that multicolor pictorial images have a glossy finish and monochromatic text and graphics have a matte finish.

Several methods for imparting glossy or matte finishes to an image have been disclosed. One method is to cover a multicolor toner image with clear, glossy toner. The clear toner can be laid down in an image configuration or it can be laid down uniformly over the whole image. See, for example, Crandall, U.S. Pat. No. 4,828,950 and Ng, U.S. Pat. No. 5,234,783.

Another method to provide glossy pictorial toner images, produced in an undercolor removal apparatus, is to lay a black matte toner down first and completely cover it by a color (cyan, magenta, yellow) toner having a more glossy finish after fusing. Examples of such methods are described in Japanese Patent Application No. 133422/87, Laid Open No. 300254/88, Dec. 7, 1988. Additional references which disclose the use of glossy and matte toner combinations include Japanese Patent Application No. 90JP-333829, Laid Open No. C92-132261, and U.S. Pat. Nos. 5,162,860 and 5,256,507.

The use of different fuser rollers or finishing apparatus to effect the gloss of a fused toner image has been considered. It has been disclosed that hard metallic rollers covered with a fluorocarbon resin can be used to produce fused toner images having high gloss. On the other hand, most soft rubber coated rollers impart a matte finish to fused images.

U.S. Pat. No. 5,118,589 discloses the use of pressure members with a predefined surface finish to impart either gloss or texture to a heat softenable layer of a receiver onto which color toner particles have been thermally transferred. The use of textured pressure members to impart texture to fixed toner images has also been disclosed in U.S. Pat. Nos. 4,258,095 and 5,085,962. U.S. Pat. No. 5,019,869 discloses an electrophotographic device in which a finish is applied to a toner image by selecting one of a plurality of finishing rollers, each roller having a different and distinct surface texture. Further, U.S. Pat. No. 5,319,429 illustrates the use of a fusing apparatus comprising two endless belts each having a glossy surface to provide glossy images.

U.S. Pat. No. 4,639,405 discloses an apparatus for providing glossy fused toner images which passes toner-bearing receivers sequentially through a first and second pair of rollers, the first pair of rollers fuses the toner, and the second pair of rollers provides gloss to the toner image.

Another method for affecting the gloss of an electrophotographic image is to change the toner binder resin rheology, and therefore, the melt flow characteristics of the toner composition. A toner which has higher melt flow properties at a given temperature, provides higher image gloss as compared to a toner formulation which has lower melt flow properties. Because the melt viscosity of a polymer changes as a function of the weight average molecular weight, substantial changes in the melt viscosity of a toner can be achieved by controlling the molecular weight of the toner binder. References which disclose that changing the molecular weight can affect the gloss include U.S. Pat. Nos. 4,913,991 and 5,258,256.

The amount of crosslinking in the toner binder polymer also can affect gloss. Typically, toners having high crosslinked polymer binders provide matte images. An example of such toner for the purpose of providing a low gloss image is detailed in U.S. Pat. No. 5,395,723.

U.S. Pat. No. 5,334,471 teaches a method of controlling gloss in an electrophotographic toner image by utilizing light-scattering particles of a specific size range. The light-scattering particles are large enough to provide a bumpy image surface which is said to impart low gloss.

As described above, in electrostatographic processes using toners, matte or glossy finishes of the fused toner image can be provided either by controlling the rheological behavior of the toner binder polymer or by controlling the surface texture of the fusing members. However, even with these methods and materials, it has not been heretofore possible to control or otherwise adjust. the gloss of a fused toner image so as to reduce the level of differential gloss within a fused toner image. Such an advantage would be particularly desirable for process color machines which employ development stations that utilize a plurality of toner compositions with differing colors. Typically, the toner compositions, after they are fused to the receiver, can form areas within the toner image which exhibit a different level of gloss relative to another area of the toner image. The result is a fused toner image having areas that appear glossier than other areas within the image, and therefore, the overall look of the image is not as visually pleasing to the human eye. It would be desirable to reduce this "differential gloss" within the image, so that the resulting image is better in appearance and more closely resembles the image quality of a lithographic print.

Furthermore, an operator of an electrostatographic printing machine may desire, from time-to-time, to adjust the overall gloss of a toner image without changing the fusing system of the machine. For example, a special print job may require a different overall gloss level (either higher or lower) in comparison to the gloss which can be typically provided by the fusing system used therein. It would be desirable to have a capability to adjust the level of gloss to meet the specifications for the job without changing the fusing system.

Therefore, as can be seen, a need exists for methods and apparatus to produce fused toner images having reduced differential gloss, i.e., gloss levels which are relatively uniform within the image, and also the overall gloss of the image to meet the specifications for a particular job.

SUMMARY OF THE INVENTION

The foregoing objects and advantages are attained by the present invention, which in one aspect, concerns apparatus for adjusting gloss of a toner image fused to a receiver medium. In an embodiment, the apparatus comprises:

- a finishing member which contacts the toner image on the receiver medium, the finishing member comprising an outer layer having a contact surface thereon comprised of a fluorocarbon thermoplastic random copolymer co-cured with a fluorinated resin;
- a pressure member positioned adjacent to and in contact with the outer contact surface of the finishing member such that a pressure nip is formed between the contact surface of the finishing member and the pressure member; and
- a heat source for transferring heat to at least one of the finishing member and the pressure member so that heat is transferred to the toner image under pressure while the toner image is passed through the pressure nip.

In another aspect, the invention relates to apparatus for fusing a toner image to a receiver medium. The apparatus comprises:

- a fusing system for fusing the toner image to the receiver medium so as to provide a fused toner image on the receiver medium, and
- a post-fusing finishing system for adjusting gloss of the fused toner image, the post-fusing finishing system comprising a finishing member which contacts the fused toner image so as to transfer heat thereto under pressure, the finishing member comprising an outer layer having a contact surface thereon including a fluorocarbon thermoplastic random copolymer co-cured with a fluorinated resin.

In another aspect, the present invention relates to a method of fusing a toner image to a receiver medium. The method comprises the steps of:

- fusing a thermoplastic toner composition to a receiver medium to provide a fused toner image thereon having an initial amount of gloss; and
- contacting the fused toner image with a finishing surface comprised of a fluorocarbon thermoplastic random copolymer co-cured with a fluorinated resin, the contact being under conditions of temperature and pressure such that gloss of the fused toner image is adjusted thereby.

Additionally, the invention also relates to a method for adjusting gloss of a fused thermoplastic toner image having an initial amount of gloss. The method comprises contacting the fused thermoplastic toner image with a finishing surface comprised of a fluorocarbon thermoplastic random copolymer co-cured with a fluorinated resin. The contact is under conditions of temperature and pressure such that gloss of the fused toner image is adjusted thereby.

In preferred embodiments, the fluorocarbon thermoplastic random copolymer co-cured with the fluorinated resin includes subunits of:

$$—CH_2CF_2)x—,\ —(CF_2CF(CF_3))y—,\ \text{and}\ —(CF_2CF_2)z—,$$

wherein:

x is from 1 to 50 or 60 to 80 mole percent, y is from 10 to 90 mole percent, z is from 10 to 90 mole percent, and x+y+z equals 100 mole percent.

In other embodiments, the fluorocarbon thermoplastic random copolymer co-cured with the fluorinated resin is the reaction product of a mixture comprising a fluorocarbon thermoplastic random copolymer, a curing agent having a bisphenol residue, a reactive filler including zinc oxide, a fluorinated resin, and an aminosiloxane.

The foregoing aspects of the invention are discussed in more detail hereinbelow.

DETAILED DESCRIPTION OF THE INVENTION

Figure 1:
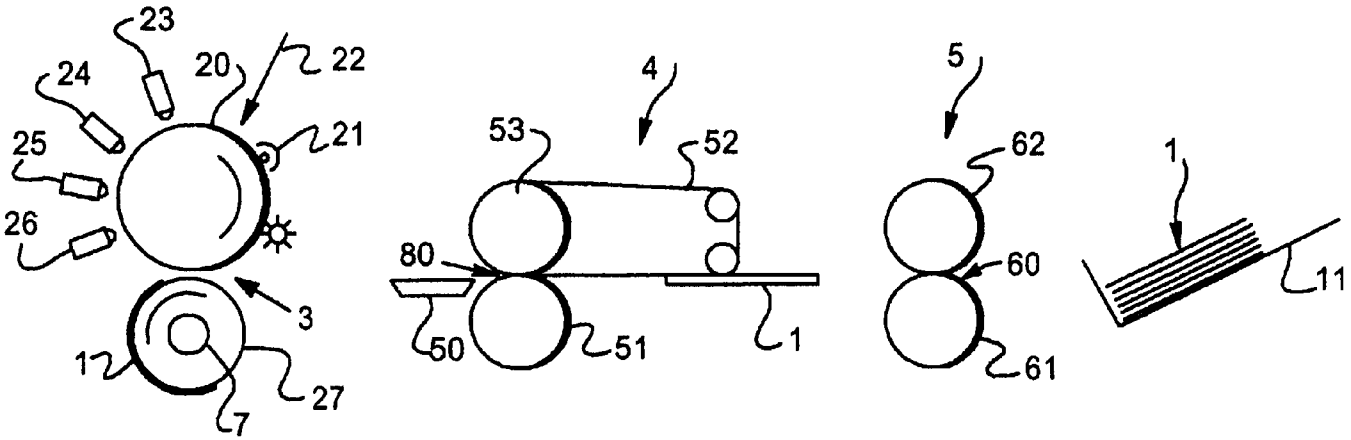
FIG. 1 is a side schematic illustrating a type of image forming apparatus in which the invention can be employed.

Referring to FIG. 1, a series of electrostatic images are formed on an image member 20 using conventional electrophotography as generally known in the art. While the present invention can be used in black & white electrophotography, it is particularly desirable for color electrophotography, such as for example that which employs a developer set comprised of a thermoplastic resin material in the form of a cyan toner, magenta toner, yellow toner, and optionally, a black toner to develop the electrostatic images. More specifically, image member 20 is uniformly charged by a charging device 21 and thereafter exposed by an exposing device, such as for example, a laser 22 to create the series of electrostatic images. Each of the images is toned by one of toning stations 23, 24, 25 and 26 (each of which employs a toner from the above-described 4-color, multicolor toner set) to create a series of different color toner images corresponding to the electrostatic images.

The receiver sheet 1 is attached to the periphery of an image transfer member 27 and rotated through a transfer nip 3 to transfer the electrostatic images on the image member 20 to the receiver sheet 1 in registration to form a multicolor image thereon. Transfer can be accomplished by heating transfer member 27 internally with a quartz lamp 7 to soften the toner being transferred. Transfer can also be assisted with an electrostatic field.

The receiving sheet 1 bearing the toner image thereon is separated from image transfer member 27 and then fed to further apparatus to be fused to the receiver sheet and finished. For example, as shown in FIG. 1, the toner image is fused to the receiver sheet by use of a fusing system 4 and thereafter further finished by adjusting gloss at a finishing system 5, which receiver sheet bearing the fused and finished toner image is finally deposited in an output tray 11.

Fusing system 4 can include an optional preheating device 50 which raises or maintains the temperature of the receiver sheet, a pair of opposed pressure rollers 51 and 53, and an endless fusing belt 52 trained about a series of rollers which includes roller 53. Rollers 51 and 53 are urged together with sufficient force to create substantial pressure in a fusing or fixing nip 80 formed between fusing belt 52 and pressure roller 51. At least one of rollers 51 and 53 is generally heated to raise or maintain the temperature of the toner above its glass transition temperature, using for example, quartz lamps (not shown) positioned within rollers 51 and/or 53. Alternatively, the rollers can be externally heated by use of external heater rollers, lamps, or other heat sources known in the art. The heat and pressure combination within fusing nip 80 causes the toner to soften and bond to the receiver sheet. If belt 52 has a hard, smooth surface, the image can be smoothed to a high initial gloss with very little undesirable contour. The receiver sheet bearing the fused toner image thereon continues out of the fusing nip 80 while maintaining contact with belt 52 until the receiver sheet has cooled to a desired temperature, such as below the glass transition temperature of the toner. At this point, receiver sheet 1 is separated from belt 52 and then sent to finishing system 5 for gloss adjustment. Cooling of the toner image before separation can allow for separation without the use of offset-preventing liquids which could degrade the fused toner image.

An example of a typical fusing system employed in the present invention is described in U.S. Pat. No. 5,778,295, the teachings of which are incorporated herein by reference in their entirety.

Figure 2:
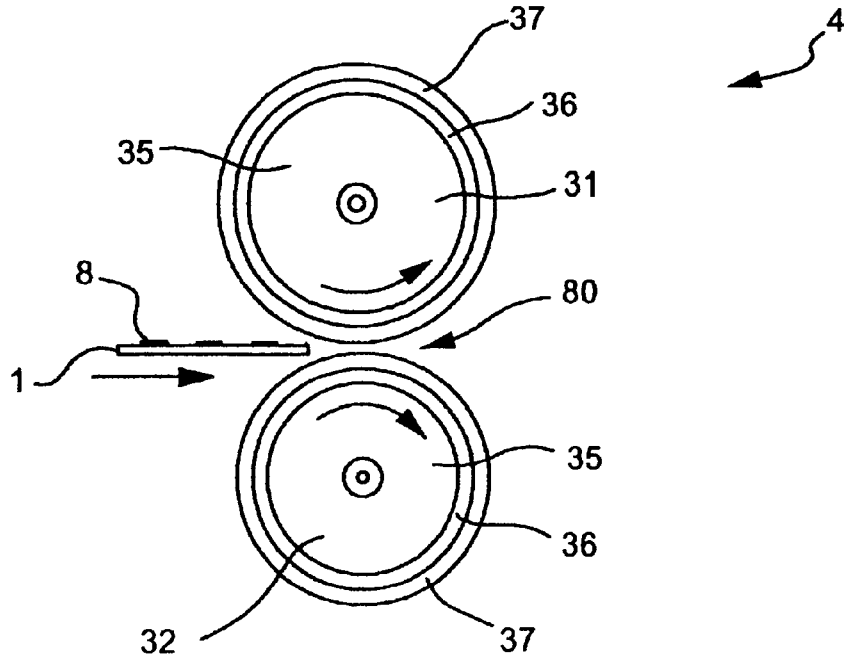
FIG. 2 is a side sectional view of another embodiment of a fusing system which may be employed in the present invention.

Alternatively, fusing system 4 can take the form of opposed pressure members in a roller form as in the arrangement illustrated for example by FIG. 2. Referring now to FIG. 2, fusing system 4 can comprise an internally heated fuser roller 31 and a pressure roller 32. Fuser roller 31 and pressure roller 32 are in pressurized contact forming a fusing nip 80 through which a receiver sheet 1 bearing a toner image 8 passes. Fuser roller 31 and pressure roller 32 rotate in the direction of the arrows shown on the respective rollers, and receiver sheet 1 moves through the fusing nip 80 in the direction of the arrow shown below the receiver sheet 1 in FIG. 2. In actual operation, fuser roller 31 and pressure roller 32 typically contact each other under pressure to form fusing nip 80, but they are not shown in contact in FIG. 2 for purposes of illustration. Passing the receiver sheet 1 between rollers 31 and 32 fuses the toner image 8 to the receiver sheet 1. Then the receiver sheet 1 bearing the fused toner image 8 is thereafter passed on to finishing system 5 as shown previously in FIG. 1.

As shown in FIG. 2, the fuser roller 31 and the pressure roller 32 can be coated with one or more layers of materials known in the art, such as an elastomeric material like silicone elastomers, fluoroelastomers, and so-called interpenetrating networks of silicone and fluoroelastomers. Such materials are disclosed, for example, in U.S. Pat. Nos. 5,141,788; 5,166,031; 5,281,506; 5,366,772; 5,370,931; 5,480,938; 5,846,643; 5,918,098; 6,037,092; 6,099,673; and 6,159,588, the teachings of which are incorporated herein by reference. The fuser roller 31 and the pressure roller 32 typically comprise a hard cylinder 35, made from, for example, a conductive metal like aluminum, and have one or more layers, such as layers 36 and 37, of materials coated on them, such as the materials previously described.

Typically, a release agent, such as a polysiloxane oil, can be applied to the surface of the fuser roller to reduce or prevent offset of toner onto the fuser roller during fusing. The release agents employed can be any of those known to the art, including those with functional groups in either a terminal position on the siloxane polymer chain, or pendant to such siloxane chain, or both, such as those release agents disclosed in U.S. Pat. Nos. 4,029,827; 4,101,686; 4,185,140; and 5,157,445 the teachings of which are incorporated by reference, which groups can interact with the outer surface of the fuser roller 31 such that a thin film of the polymeric release agent is formed on the surface of the fuser roller. In embodiments, the functional groups include carboxy, hydroxy, epoxy, isocyanate, thioether, hydride, amino, or mercapto groups, and preferably hydride, amino or mercapto groups. Blends of such release agents may also be used.

The fuser roller and/or pressure roller of the apparatus shown in FIG. 2 can be internally or externally heated, by for example, an infrared lamp, a heating coil, a radiant heater, or a contacting heated roller.

FIGS. 1 and 2 show two different fusing systems; however, it should be understood that any fusing system known to the art can be employed.

Finishing system 5 can similarly comprise finishing members in a belt and a pressure roller combination, such as that generally described hereinabove for the fusing system 4, provided the finishing member has an outer contact surface, which surface contacts the fused toner image, comprising a fluorocarbon thermoplastic random copolymer co-cured with a fluorinated resin as described hereinafter. However, as shown in FIG. 1, the finishing members employed preferably take the form of a pair of opposed roller members 61 and 62, at least one of which has an outer contact surface which contacts the fused toner image on the receiver sheet, which outer surface is comprised of the cured fluorocarbon thermoplastic random copolymer composition. In a preferred embodiment, the finishing system employs finishing members, such as the pair of opposed roller members 61 and 62, wherein both members have an outer surface comprised of the cured fluorocarbon thermoplastic random copolymer composition. In this way, receiver sheets bearing toner images on both sides thereof (as in a duplex printing operation) can be conveniently passed through the finishing system for gloss adjustment in a single pass. Again, a combination of heat and pressure is used to adjust gloss of the fused toner image as desired and described more fully hereinafter.

Figure 3:
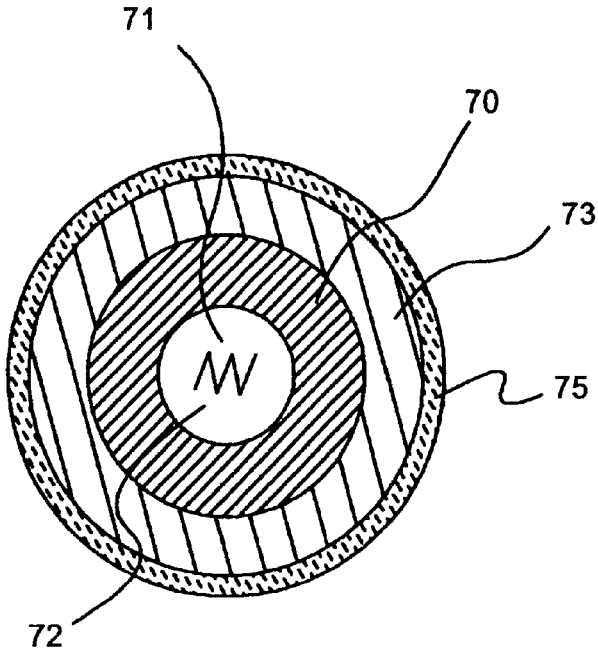
FIG. 3 is a sectional view of an embodiment of a finishing member in accordance with the present invention.

FIG. 3 illustrates an embodiment of a finishing member according to the invention. The finishing member comprises a core 70 which can be any material which is mechanically and dimensionally stable at the operating temperatures employed for adjusting gloss with finishing system 5. For example, core 70 can be made of a high-temperature resistant plastic material like polyamide-imides, or a metal like aluminum. Preferably, the core 70 is made of a thermally conductive metal, such as alumimum, particularly when the finishing member is heated by internal means, and is more preferably in a cylindrically-shaped hollow tube or solid rod form. In FIG. 3, the core 70 is shown to be in a hollow, cylindrical rod shape, with a heat source supplied within hollow portion 71 by use of a quartz lamp 72. However, a heat source external to the finishing member can also be employed, such as through use of a heated plate, radiant quartz lamp, external heater roller, or any other heat source known in the art.

Disposed on core 70 is an optional, but preferred, base cushion layer 73, as illustrated by FIG. 3, made of a conformable, complaint material so as to generate a desirable contact area within contact nip 60 shown in FIG. 1. This area, which can be described as a contact nip width, can be generally from about 0.25 millimeters (mm) (10 mils) to about 12.5 mm (500 mils), and preferably from about 3.2 mm (128 mils) to about 6.4 mm (256 mils) in distance, within contact nip 60 shown in FIG. 1. By the term "nip width", it is meant the distance between 1) the receiver sheet entry point to the contact nip 60 and 2) the receiver sheet exit point from contact nip 60. More preferably, the compliant material is a polymeric elastomer described hereinafter, and more preferably a silicone elastomer so as to provide not only a conformable, compliant material, but also high temperature resistance and mechanical stability. Disposed over the optional base cushion layer 73 is an outer layer 75 comprised of the fluorocarbon thermoplastic random copolymer co-cured with a fluorinated resin composition described hereinafter.

In general, where a base cushion layer is employed, the thickness of the combined base cushion layer and outer layer is desirably from between about 0.25 mm (10 mils) to about 12.5 mm (500 mils). Each layer is described below.

The optional base cushion layer 73 can be of any poly (organosiloxane), such as a poly(dialkylsiloxane), poly (alkylarylsiloxane), or poly(diarylsiloxane) as described in U.S. Pat. No. 5,587,245, the teachings of which are incorporated herein by reference, or a fluoroelastomer material, such as Viton® fluoroelastomers available from DuPont of Wilmington, Del., or so-called interpenetrating networks of siloxane elastomers and fluoroelastomers as previously mentioned in connection with the fuser member of fusing system 4. Preferably, the base cushion is made of a poly (organosiloxane) polymer, since siloxane polymers are generally softer and more conformable relative to fluoroelastomers. Such poly(organosiloxane) polymers can be formed by condensation or addition polymerization methods well known in the art.

In general, the poly(organosiloxane) material employed for the base cushion layer 73 in embodiments comprises a polymerized reaction product of:

(a) at least one cross-linkable poly(organosiloxane);

(b) at least one cross-linking agent;

(c) optionally, an amount of at least one particulate filler; and (d) a cross-linking catalyst in an amount effective to react the poly(organosiloxane) with the cross-linking agent.

The polymerization may be a condensation-type reaction of hydroxy-substituted poly(organosiloxanes) materials, or addition-type reaction of vinyl-substituted poly (organosiloxanes) with hydride-substituted cross-linking agents, as generally known within the art.

It is preferred to use a cross-linkable poly (dialkylsiloxane), and more preferably a poly (dimethylsiloxane), which, before crosslinking, has a weight average molecular weight of from about 10,000 to 90,000.

In one preferred embodiment, the base cushion layer 73 comprises an addition polymerized poly(dialkylsiloxane), and more preferably a poly(dimethylsiloxane). In this embodiment, the base cushion preferably comprises the addition polymerized reaction product of:

(a) at least one cross-linkable, poly(dialkylsiloxane), wherein the poly(dialkylsiloxane) is preferably a vinyl-substituted poly ($C_{1-8}$ alkylsiloxane) with terminal and/or pendant vinyl group functionality and a weight-average molecular weight before cross-linking of about 1,000 to about 90,000;

(b) from about 1 to about 50 parts by weight per 100 parts of poly (dialkylsiloxane) of finely divided filler;

(c) at least one cross-linking agent comprising a multifunctional organo-hydrosiloxane having hydride functional the poly(dialkylsiloxane); and (d) at least one cross-linking catalyst present in an amount sufficient to induce addition polymerization of the poly(dialkylsiloxane) with the organo-hydrosiloxane cross-linking agent.

The addition-crosslinked poly(dialkylsiloxane) can be formed by addition polymerization of vinyl-substituted multifunctional siloxane polymers with multifunctional organo-hydrosiloxanes, as is generally described in U.S. Pat. Nos. 5,587,245 and 6,020,038, the teachings of which are incorporated herein by reference. Such vinyl-substituted multifunctional poly(dialkylsiloxane) polymers and their preparation are known in the art. These materials are commercially available from United Chemical Technologies, Inc., Piscataway, N.J., under various designations depending upon the viscosity and molecular weight desired.

The addition cross-linking reaction is carried out with the aid of a compound including a late transition metal catalyst, such as cobalt, rhodium, nickel, palladium or platinum.

The amount of filler employed in the base cushion layer depends on the level of thermal conductivity desired therein. For example, if the finishing member 61 or 62 includes an internal heat source as previously mentioned, it would be desirable to incorporate thermally conductive filler therein to facilitate transfer of heat through the base cushion layer 73. The thermally conductive filler can be selected from inorganic metal oxides, such as aluminum oxide, iron oxide, chromium oxide, tin oxide, zinc oxide, copper oxide and nickel oxide. Silica (silicon dioxide) can also be used, as well as silicon carbide. The particle size of the filler does not appear to be critical. Particle sizes anywhere in the range of 0.1 to 100 micrometers are acceptable. The amount of filler employed can be from about 1 to about 50 parts by weight per 100 parts of the siloxane polymer.

A commercially available material for forming a crosslinked, addition-polymerized, polyorganosiloxane is GE862 silicone rubber available from GE Silicones, Waterford, N.Y. or S5100 silicone rubber available from Emerson Cuming Silicones Division of W.R.Grace and Co. of Lexington, Mass.

In addition, condensation-type poly(organosiloxanes) are also used to form base cushion layer 73. In this embodiment, the base cushion layer can comprise the condensation polymerized reaction product of:

(a) at least one cross-linkable, poly(organosiloxane) wherein the poly(organosiloxane) is preferably a hydroxy-substituted poly($C_{1-8}$ dialkylsiloxane) with terminal and/or pendant hydroxyl group functionality and a weight-average molecular weight before cross-linking of about 1,000 to about 90,000;

(b) from about 1 to about 50 parts by weight per 100 parts of the poly (organosiloxane) of finely divided filler;

(c) at least one multifunctional silane cross-linking agent having functional groups capable of condensing with the hydroxyl functional groups of the poly (organosiloxane); and (d) at least one cross-linking catalyst present in an amount sufficient to induce condensation polymerization of the poly(organosiloxane) with the multifunctional silane cross-linking agent.

Examples of preferred materials for use as a poly (organosiloxane), are condensable poly(dimethylsiloxanes) and fillers such as those disclosed in U.S. Pat. No. 5,269,740 (copper oxide filler), U.S. Pat. No. 5,292,606 (zinc oxide filler), U.S. Pat. No. 5,292,562 (chromium oxide filler), U.S. Pat. No. 5,548,720 (tin oxide filler), and U.S. Pat. No. 5,336,539 (nickel oxide), the teachings of which are incorporated herein by reference. Silanol-terminated poly (dialkylsiloxanes) are also commercially available from United Chemical Technologies, Inc. of Piscataway, N.J.

The condensation reaction is carried out with the aid of a catalyst, such as, for example, a titanate, chloride, oxide, or carboxylic acid salt of zinc, tin, iron, or lead. Specific examples of useful condensation catalysts are dibutyltin diacetate, tin octoate, zinc octoate, dibutyltin dichloride, dibutyltin dibutoxide, ferric chloride, lead dioxide, or mixtures of catalysts such as CAT50® catalyst sold by Grace Specialty Polymers of Lexington, Mass. CAT50® catalyst is believed to be a mixture of dibutyltin dibutoxide and dibutyltin dichloride diluted with butanol.

Suitable fillers to provide a desired level of thermal conductivity include those previously described.

To form the base cushion layer 73 of finishing member 61 or 62 with a cured poly(organosiloxane), at least one poly (organosiloxane), a stoichiometric excess amount of multifunctional silane to form crosslinks with the hydroxy or vinyl end groups of the poly(organosiloxane), and filler (as desired) are thoroughly mixed by any suitable method, such as with a three-roll mill. The mixture is degassed and injected into a mold surrounding the core to mold the material onto the core according to known injection molding methods. The so-treated core is kept in the mold for a time sufficient for some cross-linking to occur (e.g., generally at least about 4 hours) and allow the core to be removed from the mold without damage thereto. The so-coated member is then removed from the mold and maintained at a temperature of from about 25 to about 100° C. for at least about 1 hour so as to substantially complete reaction and/or accelerate remaining cross-linking.

The base cushion layer 73 can have a thickness that varies, but is preferably from about 0.25 mm (10 mils) to about 12.5 mm (500 mils) thick, and more preferably from about 3.2 mm (128 mils) to about 6.4 mm (256 mils) thick.

The base cushion layer 73 desirably has a hardness of from about 10 to about 80 Shore A, and preferably from about 20 to about 70 Shore A.

To form the outer layer 75 thereon, core 70 after being coated with the base cushion layer 73, is corona discharge treated to prepare the surface of the base cushion for application of the outer layer material. The outer layer 75 may then be directly applied thereto by forming a solution (as described hereinafter) of a mixture comprised of uncured fluorocarbon thermoplastic random copolymer, aminosiloxane, bisphenol residue cure agent, reactive filler including zinc oxide, and any other desired additives. The solution is then applied to the base cushion coated core by known solution or ring coating methods, and cured as described below to obtain the desired product.

If a base cushion layer is not desired, then the outer layer 75 may be directly applied to the core 70 by the foregoing coating method and cured.

According to the present invention, outer layer 75 comprises a co-cured fluorocarbon thermoplastic random copolymer and fluorinated resin material, preferably those disclosed in U.S. patent application Ser. No. 09/609,561 filed on Jun. 30, 2000 and the related applications mentioned above, the teachings of which have been incorporated herein by reference in their entirety. By "cured", it is meant that the fluorocarbon thermoplastic random copolymer and fluorinated resin starting materials are reacted with curing agents, such that the resulting product is not thermoplastic in nature and retains its shape at the elevated temperatures typically employed in fusing systems, such as up to about 180° C. In general, the cured fluorocarbon random copolymer material has subunits of the following:

$$—(CH_2CF_2)x—,\ —(CF_2CF(CF_3))y—,\ \text{and}\ —(CF_2CF_2)z—$$

wherein:

x is from about 1 to about 50 or from about 60 to about 80 mole percent, y is from about 10 to about 90 mole percent, z is from about 10 to about 90 mole percent, and x+y+z equals 100 mole percent.

The foregoing subunits can also be described as follows:

$—(CH_2\ CF_2)—$ is a vinylidene fluoride subunit ("$VF_2$"), $—(CF_2CF(CF_3))—$ is a hexafluoropropylene subunit ("HFP"), and $—(CF_2\ CF_2)—$ is a tetrafluoroethylene subunit ("TFE").

In the above formulas, x, y, and z are mole percentages of the individual subunits relative to a total of the three subunits (x+y+z), referred to herein as "subunit mole percentages". The curing agent can be considered to provide an additional "cure-site subunit"; however, the contribution of these cure-site subunits is not considered in subunit mole percentages. In the fluorocarbon thermoplastic random copolymer, x has a subunit mole percentage of from about 1 to about 50 or about 60 to about 80 mole percent, y has a subunit mole percentage of from about 10 to about 90 mole percent, and z has a subunit mole percentage of from about 10 to about 90 mole percent. In a currently preferred embodiment, subunit mole percentages are: x is from about 30 to about 50 or about 70 to about 80, y is from about 10 to about 20, and z is from about 10 to about 50; or more preferably x is from about 40 to about 50, y is from about 10 to about 15, and z is about 40 to about 50. In the currently preferred embodiments, x, y, and z are selected such that fluorine atoms represent at least about 65 mole percent of the total formula weight of the $VF_2$, HFP, and TFE subunits.

Suitable fluorocarbon thermoplastic random copolymers (in uncured form) employed in practicing the invention are available commercially. In a particular embodiment of the invention, a vinylidene fluoride-co-tetrafluoroethylene-co-hexafluoropropylene is used which can be represented as —(VF)(75)—(TFE)(10)—(HFP)(25)—. This material is marketed by Hoechst Company under the designation "THV Fluoroplastics" and is referred to herein as "THV". In another embodiment, a vinylidene fluoride-co-tetrafluoroethylene-co-hexafluoropropylene is used which can be represented as —(VF)(49)—(TFE)(41)—(HFP)(10)—. This material is marketed by the Minnesota Mining and Manufacturing Company, St. Paul, Minn., under the designation "3M THV" and is referred to herein as "THV-200A". Other suitable uncured vinylidene fluoride-co-hexafluoropropylenes and vinylidene fluoride-co-tetrafluoroethylene-cohexafluoropropylenes are available, for example, as THV-400, THV-500, and THV-300, also from 3M.

In general, THV fluoroplastics are set apart from other melt-processable fluoroplastics by a combination of high flexibility and low processing temperatures. With flexural modulus values between 83 Mpa and 207 Mpa, THV fluoroplastics are generally the most flexible of the fluoroplastics.

The molecular weight of the uncured polymer is largely a matter of convenience, however, an excessively large or excessively small molecular weight would create problems, the nature of which are well known to those skilled in the art. In a preferred embodiment of the invention the uncured polymer has a number average molecular weight in the range of about 100,000 to 200,000.

The curing agent is preferably a bisphenol residue. By the term "bisphenol residue", it is meant bisphenol or a derivative such as bisphenol AF. The composition of outer layer 75 further includes a particulate reactive filler including zinc oxide, and also an aminosiloxane. The aminosiloxane is preferably an amino-functionalized poly(dimethylsiloxane) copolymer, more preferably an amino-functionalized poly (dimethylsiloxane) (due to availability) comprising amino-functional units selected from the group consisting of (aminoethylaminopropyl) methyl, (aminopropyl) methyl and (aminopropyl) dimethyl.

A fluorinated polymer resin, which acts as a release agent, and having no C-H bond in the polymer backbone, such as polytetrafluoroethylene (PTFE) or polyfluoroethylenepropylene (FEP), is incorporated into the copolymer to enhance the reduction in differential gloss within the fused toner image and also impart surface lubricity, cleanability, and reduce potential contamination caused by toner offset. Such fluorinated resins are commercially available from DuPont. Fluorinated resins can have a number average molecular weight of from about 50,000 to about 50,000,000, preferably from about 200,000 to about 1,000,000.

The amount of fluorinated resin employed can vary significantly and still obtain the benefits of the invention. Preferably, the amount of fluorinated resin employed range from about 2 to about 50 weight percent, based on the combined weight of the fluorocarbon thermoplastic random copolymer and fluorinated resin employed.

As disclosed in our copending U.S. patent application Ser. No. 10/158,601 filed concurrently herewith and previously incorporated by reference hereinabove, the amount of the fluorinated resin employed in preparing the contact surface can be varied and thereby tune, i.e., adjust the surface gloss thereof to a desired level. In this way, a thermoplastic toner image passed therethrough can be adjusted to a pre-set gloss level.

In another embodiment, the invention provides, not only adjustment of differential gloss, but also adjustment of the overall gloss level for a fused toner image. For example, and as illustrated by Examples 2–6 hereinafter, it is possible to employ a finishing system incorporating a contact surface comprised of the fluorocarbon thermoplastic random copolymer co-cured with fluorinated resin material so as to reduce overall gloss of the image from undesirably high levels to within a certain specification for gloss. The operator of the electrostatographic machine can therefore alter the overall gloss level produced by the machine to meet a desired gloss specification, by selecting the appropriate finishing member which will produce such level of gloss.

By overall gloss of a fused toner image, it is meant the G60 gloss (as described hereinafter) for the area of the image having the highest density of toner thereon and therefore maximum amount of gloss. As known in the art, gloss specifications for printing equipment are generally made in reference to a standard color patch employed by the company that manufactures the equipment. The standard patch will typically have a known toner laydown density for a specified fully saturated color, and also have a specified size.

A preferred class of curable amino-functional siloxanes, based on availability, includes those having functional groups such as aminopropyl or aminoethylaminopropyl pendant from a poly(siloxane) backbone (more preferably a poly(dimethylsiloxane) backbone), such as DMS-A11, DMS-A12, DMS-A15, DMS-A21 and DMS-A32 (all sold by Gelest, Inc. of Tullytown, Pa.) having a number average molecular weight between 850 and 27,000. Examples of preferred curable amino-functional polydimethyl siloxanes are bis(aminopropyl) terminated poly(dimethylsiloxanes). Such oligomers are available in a series of molecular weights as disclosed, for example, by Yilgor et al., in "Segmented Organosiloxane Copolymer", Polymer, 1984, V. 25, pp. 1800–1806. Other curable amino-functional polydimethyl siloxanes that can be used are disclosed in U.S. Pat. Nos. 4,853,737 and 5,157,445, the disclosures of which are also hereby incorporated by reference.

The cured fluorocarbon thermoplastic random copolymer compositions include a reactive filler comprising zinc oxide. The zinc oxide particles can be obtained from any convenient commercial source, such as Atlantic Equipment Engineers of Bergenfield, N.J. In a currently preferred embodiment, the particulate zinc oxide filler has a total concentration in the compositions of the invention of from about 1 to 20 parts per hundred parts by weight of the fluorocarbon thermoplastic random copolymer (pph). In a particular embodiment of the invention, the composition has about 3 to 15 pph of zinc oxide.

The particle size of the zinc oxide filler does not appear to be critical. Particle sizes anywhere in the range of about 0.1 to 100 micrometers are acceptable.

In addition to using zinc oxide filler as provided hereinabove, antimony-doped tin oxide particles can be added as a catalyst so that curing of the fluorocarbon thermoplastic random copolymer can be achieved with shorter reaction times and/or at temperatures of as low as room temperature, i.e., about 25° C. This technique is disclosed in copending U.S. patent application Ser. No. 09/609,562 filed on Jun. 30, 2000, the teachings of which have been incorporated herein by reference in their entirety. Antimony-doped tin oxide particles can be obtained from Keeling & Walker, Stoke-on-Trent, of the United Kingdom; E.I. du Pont de Nemours and Company of Wilmington, Del.; or Mitsubishi Metals, Inc. of Japan. A preferred amount of such antimony-doped tin oxide is from about 3 to about 20 pph by weight of the fluorocarbon thermoplastic random copolymer composition employed, and more preferably from about 3 to about 15 pph. The amount of antimony in such particles is preferably from about 1 to about 15 weight percent, based on total weight of the particles, and more preferably from about 3 to about 10 weight percent.

In addition to the zinc oxide reactive filler, the outer layer 75 can further comprise, as an optional component, a particulate thermally-conductive filler material, such as those previously mentioned for the base cushion layer. However, such fillers are not preferred, since they can promote contamination of the finishing member with toner and reduce overall gloss to an undesired level.

Preferred cured fluorocarbon thermoplastic random copolymer compositions employed for the outer layer have a weight ratio of aminosiloxane polymer to fluorocarbon thermoplastic random copolymer of between about 0.01 and about 0.2 to 1 by weight, and preferably from between about 0.05 and about 0.15 to 1. The composition is preferably obtained by curing a mixture comprising from about 45–90 weight percent of a fluorocarbon thermoplastic random copolymer; about 5–20 weight percent, most preferably about 5–10 weight percent, of a curable amino-functional siloxane copolymer; about 1–5 weight percent of a bisphenol residue, about 1–20 weight percent of a zinc oxide acid acceptor type filler, and about 3–45 weight percent of fluorinated resin, based on total weight of the composition.

To form the outer layer composition in accordance with the present invention, known solution coating methods can be used, wherein the uncured fluorocarbon thermoplastic random copolymer, fluorinated resin, reactive filler including zinc oxide, aminosiloxane, bisphenol residue curing agent, and any other desired additives, are mixed in an organic solvent such as methylethylketone or methylisobutylketone. The solution is then applied to a core or other substrate (with base cushion layer, if desired, already coated thereon), and thereafter cured as described hereinafter.

The fluorocarbon thermoplastic random copolymer and fluorinated resin mixture is essentially cured by crosslinking with basic nucleophile addition curing. Basic nucleophilic cure systems are in general known and are discussed, for example, in U.S. Pat. No. 4,272,179. One example of such a cure system combines a bisphenol residue as the curing agent and an organophosphonium salt, as an accelerator. The curing agent is incorporated into the polymer as a cure-site subunit, for example, bisphenol residues. Other examples of nucleophilic addition cure systems are sold commercially as DIAK No. I (hexamethylenediamine carbamate) and DIAK No. 3 (N,N'-dicinnamylidene-I, 6-hexanediamine) by DuPont.

Curing of the fluorocarbon thermoplastic random copolymer can be carried out at much shorter curing cycles compared to the well known conditions for curing conventional fluoroelastomer copolymers. For example, the curing of fluoroelastomers is usually from 12–48 hours at temperatures of about 220° to 250° C. Typically, such fluoroelastomer coating compositions are dried until solvent free at room temperature, then gradually heated to about 230° C. over 24 hours, then maintained at that temperature for 24 hours. By contrast, the cure of the fluorocarbon thermoplastic random copolymer compositions can be attained by heating the uncured mixture for as short as 3 hours at a temperature of 220° C. to 280° C. and an additional 2 hours at a temperature of 250° C. to 270° C. If antimony-doped tin oxide particles are employed, then the mixture can be cured at a temperature of as low as 25° C. over a period of at least about 2 hours.

The outer layer 75 desirably has a thermal conductivity of from about 0.15 to about 0.40 BTU/hr-ft-° F. when an internal heat source, such as lamp 72, is used, so that the outer layer has sufficient heat capacity to effectively conduct heat to the receiver sheet. Thermal conductivity of the outer layer can be adjusted by varying the thickness of the outer layer so as to obtain a desired level of thermal conductivity, or alternatively, but less preferred, thermally-conductive fillers as described above, can be added. Thermal conductivity can be measured by the procedure and equipment described in ASTM Method F433-77.

The outer layer 75 should be at least about 0.5 mils (12.5 pm) in thickness to have a desirable amount of mechanical strength and/or heat storage capacity, and preferably it has a thickness of from about 1 mil (25 pm) to about 4 mils (100 $\mu$m). A thickness of greater than 4 mils is less preferred, since the outer layer will tend to act as a heat sink and heat transfer can be inefficient.

In terms of hardness, the outer layer preferably has a Durometer hardness of greater than about 20 Shore A, and preferably from about 50 to about 80 Shore A as determined by accepted analytical methods known in the art, i.e., ASTM Standard D2240, as mentioned in U.S. Pat. No. 5,716,714, the relevant teachings of which are incorporated herein by reference.

In practicing the invention, the conditions at which contact occurs between the contact surface of the outer layer and toner image can vary and still obtain the desired reduction in differential gloss. An advantage of the cured fluorocarbon thermoplastic random copolymer composition employed in the outer layer is its ability to withstand elevated temperatures commonly employed in fusing toner images. In preferred embodiments, the surface temperature of the outer layer of the finishing member during contact is from about 150° C. to about 230° C., and more preferably from about 175° C. to about 220° C. The pressure within the contact nip is preferably from about 20 to about 120 pounds per square inch (psi), and more preferably from about 60 to about 100 psi.

Any receiver known in the art can be used in the method and apparatus of this invention, including various metal films, such as alumina and copper, metal-coated plastic films, organic polymeric films, and various types of paper. Polyethylene terephthalate is an excellent transparent polymeric receiver for forming transparencies. The most preferred receivers are paper and coated papers like those disclosed in U.S. Pat. No. 5,037,718.

Any toners can be used in the method and apparatus of this invention. Useful toner binder polymers include vinyl polymers, such as homopolymers and copolymers of styrene and condensation polymers such as polyesters and copolyesters, as well as polyethers. Also especially useful are polyesters of aromatic dicarboxylic acids with one or more aliphatic diols, such as polyesters of isophthalic or terephthalic acid with diols such as ethylene glycol, cyclohexane dimethanol and bisphenols. Preferred toners are those with a relatively low viscosity of from about 3,000 to about 10,000 poise, such as those which use non-crosslinked polyesters and polyether resins as a binder resin.

Binder materials useful in the toner particles used in the method of this invention can be amorphous or semicrystalline polymers. The amorphous toner binder compositions have a Tg in the range of about 45° C. to 120° C., and often from about 50° C. to 70° C. The useful semi-crystalline polymers have a Tm in the range of about 50° C. to 150° C., and more preferably between about 60° C. and 125° C. The thermal characteristics, such as Tg and Tm, can be determined by conventional methods, e.g., differential scanning calorimetry (DSC).

Numerous colorant materials selected from dyestuffs or pigments can be employed in the toner particles used in the invention. Such materials serve to color the toner and/or render it more visible. Suitable toners can be prepared without the use of a colorant material where it is desired to have developed toner image of low optical densities. In those instances where it is desired to utilize a colorant, the colorants can, in principle be selected from virtually any of the compounds mentioned in the Colour Index Volumes 1 and 2, Second Edition. Suitable colorants include those typically employed in cyan, magenta and yellow colored toners. Such dyes and pigments are disclosed, for example, in U.S. Reissue Pat. No. 31,072 and in U.S. Pat. Nos. 4,160,644; 4,416,965; 4,414,152; and 2,229,513. One particularly useful colorant for toners to be used in black and white electrostatographic copying machines and printers is carbon black. The amount of colorant added may vary over a wide range, for example, from about 1 to 40 percent of the weight of binder polymer used in the toner particles. Mixtures of colorants can also be used.

Another component of the toner composition is a charge control agent. The term "charge control" refers to a propensity of a toner addendum to modify the triboelectric charging properties of the resulting toner. A very wide variety of charge control agents for positive charging toners are available. A large, but lesser number of charge control agents for negative charging toners is also available. Suitable charge control agents are disclosed, for example, in U.S. Pat. Nos. 3,893,935; 4,079,014; 4,323,634; 4,394,430; and British Patent Nos. 1,501,065 and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188; and 4,780,553. Mixtures of charge control agents can also be used.

Another component which can be present in the toner composition useful in this invention is an aliphatic amide or aliphatic acid. Suitable aliphatic amides and aliphatic acids are described, for example, in Practical Organic Chemistry, Arthur I. Vogel, 3rd Ed. John Wiley and Sons, Inc. NY (1962); and Thermoplastic Additives: Theory and Practice, John T. Lutz Jr. Ed., Marcel Dekker, Inc., NY (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ehthylene bis(oleamide), ethylene bis(stearamide), ethylene bis (behenamide) and long chain acids including stearic, lauric, montanic, behenic, oleic and tall oil acids. Particularly preferred aliphatic amides and acids include stearamide, erucamide, ethylene bis-stearamide and stearic acid. The aliphatic amide or aliphatic acid is present in an amount from about 0.5 to 30 percent by weight, preferably from about 0.5 to 8 percent by weight. Mixtures of aliphatic amides and aliphatic acids can also be used.

One useful stearamide is commercially available from Witco Corporation as KEMAMIDE S. A useful stearic acid is available from Witco Corporation as HYSTERENE 9718.

The toner can also contain other additives of the type used in previous toners, including magnetic materials, such as magnetite, pigments, leveling agents, waxes, surfactants, stabilizers, and the like. The total quantity of such additives can vary. A present preference is to employ not more than about 10 weight percent of such additives on a total toner powder composition weight basis.

Toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The toner compositions of the invention can be made according to a process like the evaporative limited coalescence process described in U.S. Pat. No. 4,883,060, the disclosure of which is hereby incorporated by reference. Alternatively, the toners can be commercially obtained from Eastman Kodak Co. and other toner manufacturers.

The toner can also be surface treated with small inorganic particles, such as metal oxides like titanium oxide, silica, and mixtures thereof, to impart powder flow, cleaning and/or improved transfer.

The toners applied to the receiver in this invention can be part of a developer which comprises a carrier and the toner. Carriers can be conductive, non-conductive, magnetic, or non-magnetic. Carriers are particulate in nature and can be glass beads; crystals of inorganic salts such as aluminum potassium chloride, ammonium chloride, or sodium nitrate; granules of zirconia, silicon, or silica; particles of hard resin such as poly(methyl methacrylate); and particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571. Especially useful in magnetic brush development are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; 4,764,445; 5,306,592; and 4,546,060.

Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618; 3,898,170; and Belgian Patent No. 797,132. One currently preferred carrier coating is a mixture of poly (vinlyidene fluoride) and poly(methyl methacrylate) as described for example in U.S. Pat. Nos. 4,590,140; 4,209,550; 4,297,427; and 4,937,166.

In a particular embodiment, the developer contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are preferably from 20 to 200 micrometers.

The developer can be made by simply mixing the described toner and the carrier in a suitable mixing device. The components are mixed until the developer achieves a maximum charge. Useful mixing devices include roll mills and other high energy mixing devices.

The term "particle size" used herein, or the term "size", or "sized" as employed herein in reference to the term "particles", means the median volume weighted diameter as measured by conventional devices, such as a Coulter Multisizer, sold by Coulter, Inc. of Hialeah, Fla. Median volume weighted diameter is the diameter of an equivalent weight spherical particle which represents the median for a sample.

Differences in gloss levels within areas of a fused toner image can generally be readily perceptible to the unaided eye; however, it is preferred that they be measured by a specular glossmeter using conventional techniques well known to those in the art, for example, the method described in ASTM-523-89 (1999).

In the examples described hereinafter, the Gardner gloss value is essentially a ratio determined by measuring the amount of light reflected off a fused toner image at a specific angle measured from a line perpendicular to the surface of the image, and dividing the foregoing by the amount of light introduced to the image at the same angle on the opposite side of the perpendicular line. The angles off the perpendicular line at which the gloss measurements are commonly taken are 20°, 60°, and 85° using a Gardner Micro-TRI-Gloss 20-60-85 Glossmeter, available from BYK Gardner USA of Rivers Park, Md. The gloss value as measured by the Gardner Glossmeter is often reported as a G next to a number representing the size of the specific angle used in measuring gloss, that is for example, G20, G60, and G85. As used herein, Gardner gloss levels are measured at an angle of 600 (and therefore stated as a G60 gloss value) unless otherwise stated.

The measured Gardner gloss for fused toner images formed in this invention are typically at least about 10 (in terms of G60 gloss units), and can be as high as 100. The present invention is particularly useful for adjusting gloss of fused toner images having an initial overall gloss of from about 20 to about 70 Gardner G60 gloss units. The adjustment in overall gloss can be as much as at least about ±5 Gardner G60 gloss units, and in some cases at least about ±20 Gardner G60 gloss units.

The present invention also provides fused toner images having a reduced amount of differential gloss within the image, particularly for process color printing. In other words, after subjecting the fused toner image to treatment with the finishing member as previously described, the difference between the Gardner gloss levels within the fused toner image (in other words, the highest Gardner gloss value measured within the image minus the lowest Gardner gloss value measured for the image) is reduced in comparison to such difference in Gardner gloss values measured for the fused toner image prior to the finishing treatment described herein. For example, after fusing a toner image to a receiver, it is common to obtain a fused toner image wherein such difference in measured Gardner gloss levels is at least about 5 Gardner gloss units, and typically much more, such as a difference of from about 10 to about 20 Gardner gloss units or more, which differences are generally noticeable and not as visually pleasing to the human eye. According to the present invention, this difference can be reduced significantly, and image quality approaching lithographic print quality can be attained, by subjecting the fused toner image to the finishing treatment described herein. As with a determination of overall gloss, as previously mentioned, a useful way to analyze for differential gloss is to select and fuse a plurality of separate standard color patches of known color density and toner laydown density to a receiver, such as the four color patches described in the examples hereinafter. As mentioned above, the difference in gloss between the color patches, prior to contact with the finishing surface of the present invention, can be significant as is illustrated by the examples hereinafter. However, after contact with the finishing surface of the invention, this difference can be significantly reduced. Desirably, the reduction in differential gloss is at least about 20%, preferably at least about 40%, and more preferably at least about 80%. In the most preferred embodiments, the present invention can reduce the differential gloss by as much as 90%, thereby providing a fused toner image wherein the gloss level is essentially uniform in appearance throughout the fused toner image.

The adjustment of gloss for a toner image according to the present invention is illustrated by the following examples and comparative examples.

SPECIFIC EMBODIMENT OF THE INVENTION

The following examples are intended to illustrate specific embodiments of the present invention and should not be construed as limiting the scope thereof. Unless otherwise indicated, all parts and percentages are by weight and temperatures are in degrees Celsius (° C.).

EXAMPLE 1

Preparation of a Finishing Roller

A core comprised of a cylindrical aluminum tube having a length of 15.2 inches and an outer diameter of 3.5 inches is initially cleaned with dichloromethane and dried. The outer surface of the core is then primed with a uniform coat of a silicone primer, i.e., GE 4044 silicone primer available from GE Silicones of Waterford, N.Y. The core is then air-dried.

A silicone base cushion layer is then applied to the so-treated core. Initially, a silicone mixture is first prepared by mixing in a three roll mill 100 parts of EC-4952 (a hydroxy-terminated poly(dimethylsiloxane) base compound) obtainable from Emerson Cuming Silicones Division of W.R.Grace and Co. of Lexington, Mass. The EC-4952 base compound is believed to contain a hydroxy-terminated poly(dimethylsiloxane) polymer with about 33% by weight, based on the weight of the EC-4952 base compound, of aluminum oxide and iron oxide therein as thermally conductive fillers. The EC 4952 base compound includes a cross-linking agent which is added by the manufacturer. An effective amount (about 1 part catalyst to 300 parts base compound) of dibutyltin diacetate catalyst is added to the mill to initiate curing of the material according to the manufacturer's directions.

The above-described silicone mixture is then degassed and blade coated onto the core according to conventional methods. The so-coated core is maintained at room temperature, i.e. a temperature of 25° C., for about 24 hours. The core is then placed in a convection oven wherein the temperature therein is ramped to 410° F. (210° C.) over a period of 12 hours, followed by an 48 hour hold at 410° F. (210° C.) to substantially complete curing of the silicone mixture. The so-coated core is then allowed to cool to room temperature, and the poly(dimethylsiloxane) base cushion layer is thereafter ground to provide a layer having a thickness of about 5 mm (200 mils). The base cushion is then subjected to corona discharge treatment at a power level of 750 watts for 15 minutes.

Thereafter, an outer layer of thermoplastic fluorocarbon random copolymer co-cured with a fluorinated resin is applied to the so-coated core. Initially, a fluorocarbon mixture is prepared by mixing in a two roll mill 100 parts of THV 200A fluorocarbon thermoplastic random copolymer, 6 parts of zinc oxide particles, 14 parts of aminosiloxane, and 40 parts of polyfluoroethylenepropylene (FEP) resin. THV200A is a commercially available fluorocarbon thermoplastic random copolymer sold by 3M Corporation of St. Paul, Minn. The zinc oxide particles are available from Atlantic Equipment Engineers of Bergenfield, N.J. The aminosiloxane is DMS-A21, commercially available from Gelest, Inc. of Tullytown, Pa. The fluorinated resin, polyfluoroethylenepropylene (FEP), is commercially available from DuPont of Wilmington, Del. The above-described mixture also includes 3 parts of Curative 50, also available from DuPont. The mixture is thoroughly mixed and thereafter used to form a 15 weight percent solution of the mixture in methylethylketone.

Part of the above-described solution is then ring coated by well-known methods over the cured polysiloxane base cushion overlying the core. The so-coated core is then air dried for 16 hours, baked with a 2.5 hour ramp to 275° C., given a 30 minute soak at 275° C., and then held 2 hours at 260° C. The resulting layer of cured fluorocarbon thermoplastic random copolymer has a thickness of 1 mil.

COMPARATIVE Examples A–E

The electrostatographic machine employed in Comparative Examples A–E has a belt-type fusing system corresponding substantially to that described in U.S. Pat. No. 5,778,295, the teachings of which have been incorporated herein by reference, and also in FIG. 1, except that a post-fusing finishing system is not activated.

Initially, fused toner images are created using a belt-type fuser that employs a 3 mil polyimide seamless-endless belt (web) that is 15 inches wide and 24 inches in circumference. The belt also has a 2 mil coating of the silsesquioxane polymer substantially as described in Example 2 of U.S. Pat. No. 5,778,295. The upper fusing roller (for example, member 53 on FIG. 1) has a 3.0 inch outer diameter, and consists of an aluminum core with a 0.020 inch layer of Silastic J polydimethylsiloxane (available from Dow Corning Company of Midland, Mich.) silicone rubber thereon as an outer coating. The lower pressure roller (for example, member 51 of FIG. 1) has a 0.125 inch thick layer of the Silastic J polydimethylsiloxane material over a 3.0 inch outer diameter aluminum core. The fusing belt wraps around the upper fusing roller, passes between the pressure and fusing rollers, which are pressed together to form a fusing nip, and continues on around a steering roller (for example one of the unnumbered rollers in fusing system 4 of FIG. 1), then back to the upper fusing roller, thereby completing an endless loop. The steering roller is electronically controlled to keep the belt on track.

The belt fuser described above forms a 0.250 inch nip width at approximately 100 psi of nip pressure, and the fuser is run at a process velocity of 1.5 inches per second. The temperature of the belt within the fusing nip is maintained at 160° C.

The receiver employed is a 240 g/m$^2$ glossy, clay-coated, paper sheet. In each of Comparative Examples A–E, this receiver is run through the above-described belt-type fusing system, but not the post-fusing finishing system as will be described in Examples 2–6 below, to provide a receiver having four separate, fused process color toner patches thereon—one each of red, blue, green, and black—which are fused to an initial relatively high Gardner gloss value. Between the respective runs for Comparative Examples A–E, the set point temperature for the surface of fusing belt at the point where the receiver sheet is separated from the belt is adjusted, so that the fused color toner patches obtained in a run will have different, measured initial Gardner gloss values.

The toners employed are cyan, magenta, and yellow Ricoh Type F thermoplastic polyether-based toners obtained from the Ricoh Company of Japan.

A receiver bearing the fused process color toner patches is then retrieved from the machine for each run associated with Comparative Examples A–E, and the gloss for each color patch on the receiver sheet is measured with the previously described Gardner micro-TRI-gloss device at a 600 angle. Gloss is measured in three separate locations on each patch, with the gloss device oriented in the same direction for each measurement, i.e., in a portrait or landscape orientation. The initial G60 gloss is the average of the three measurements. The initial G60 gloss values measured for each patch obtained by the respective run associated with Comparative Examples A–E are shown in Table I and illustrated by FIG. 4.

EXAMPLES 2–6

Use of Finishing Roller at Various Contact Temperatures

In Examples 2–6, a pair of finishing rollers prepared substantially according to Example 1 are used in a post-fusing finishing system to adjust gloss of a receiver sheet bearing the fused process color toner patches obtained in the respective runs described in Comparative Examples A–E. The electrostatographic machine employed is substantially as described in Comparative Examples A–E above, except that a post-fusing finishing system substantially as described in FIG. 1 is used.

The post-fusing finishing system employed for Examples 2–6 uses two of the finishing rollers prepared substantially as described in Example 1 and oriented in the configuration as described for finishing rollers 61 and 62 of FIG. 1. The finishing rollers are pressed together to form a heated contact nip. The heat is provided from use of quartz lamps positioned inside of each finishing roller. In Example 2, the heat supplied to one finishing roller (upper roller) which contacts the fused toner images as described hereinafter, is set such that the surface of the outer layer of the fluorocarbon thermoplastic random copolymer co-cured with FEP is maintained at a temperature of 300° F. (148.9° C.). The heat supplied to the other finishing roller (lower roller) is set to maintain the surface of such roller at a temperature of 190° F. (87.8° C.). The process is set such that the heated pressure nip width and process velocity results in a 50 millisecond residence time within the nip. The pressure nip is set at a pressure of 100 pounds per square inch (psi).

In Example 2, a portion of the receivers bearing the fused process color toner patches obtained from Comparative Example A are passed through the above-described finishing rollers under the recited conditions.

For Example 3, the procedure of Example 2 is substantially repeated, except that a portion of the receivers bearing the fused process color toner patches obtained from Comparative Example B are passed through the above-described finishing rollers with the upper roller set at a temperature of 325° F. (162.8° C.).

For Example 4, the procedure of Example 2 is substantially repeated, except that a portion of the receivers bearing the fused process color toner patches from Comparative Example C are passed through the finishing rollers with the upper roller set at a temperature of 375° F. (190.6° C.).

For Example 5, the procedure of Example 2 is substantially repeated, except that a portion of the receivers bearing the fused process color toner patches from Comparative Example D are passed through the finishing rollers with the upper roller set at a temperature of 414° F. (212.2° C.).

For Example 6, the procedure of Example 2 is substantially repeated, except that a portion of the receivers bearing the fused process color toner patches from Comparative Example E are passed through the finishing rollers with the upper roller set at a temperature of 450° F. (232.2° C.).

In Examples 2–6, the receivers obtained after passing through the finishing rollers are retrieved from the machine, and the G60 gloss values for each process color toner patch are measured with the Gardner micro-TRI-gloss device substantially as described in Comparative Examples A–E. The Gardner gloss values obtained for Examples 2–6 are shown in Table I and illustrated by FIG. 4 for comparison with the initial G60 values obtained for Comparative Examples A–E.

TABLE I

GLOSS DATA FOR COMPARATIVE EXAMPLES A–E AND EXAMPLES 2–6

| Finishing Roller Temp. | G 60 Initial Gloss | | | | | G 60 Final Gloss | | | | | Δ Gloss | Δ Gloss | Change |
|---|---|---|---|---|---|---|---|---|---|---|---|---|---|
| (° F.) | Blue | Green | Red | Black | Std. | Blue | Green | Red | Black | Std. | Initial | Final | (%) |
| 300 | 44.8 | 48.0 | 64.3 | 57.7 | 8.95 | 31.5 | 33.8 | 41.4 | 36.1 | 4.24 | 19.5 | 9.9 | 49.2 |
| 325 | 60.4 | 46.4 | 56.1 | 51.7 | 6.00 | 22.1 | 16.9 | 23.0 | 24.1 | 3.19 | 14.0 | 7.2 | 48.6 |
| 375 | 30.2 | 28.7 | 32.1 | 33.6 | 2.15 | 22.5 | 23.1 | 22.8 | 21.9 | 0.51 | 4.9 | 1.2 | 75.5 |
| 414 | 36.0 | 36.9 | 53.6 | 41.0 | 8.09 | 17.1 | 17.6 | 17.8 | 16.7 | 0.50 | 7.6 | 1.1 | 93.8 |
| 450 | 41.8 | 47.4 | 51.5 | 34.9 | 7.20 | 16.1 | 17.2 | 16.7 | 18.8 | 1.16 | 16.6 | 2.7 | 83.7 |

•Std means the standard deviation of the gloss data for all four colors at the stated finishing temperature, for either G60 Initial Gloss or G60 Fixed Gloss respectively.

Figure 4:
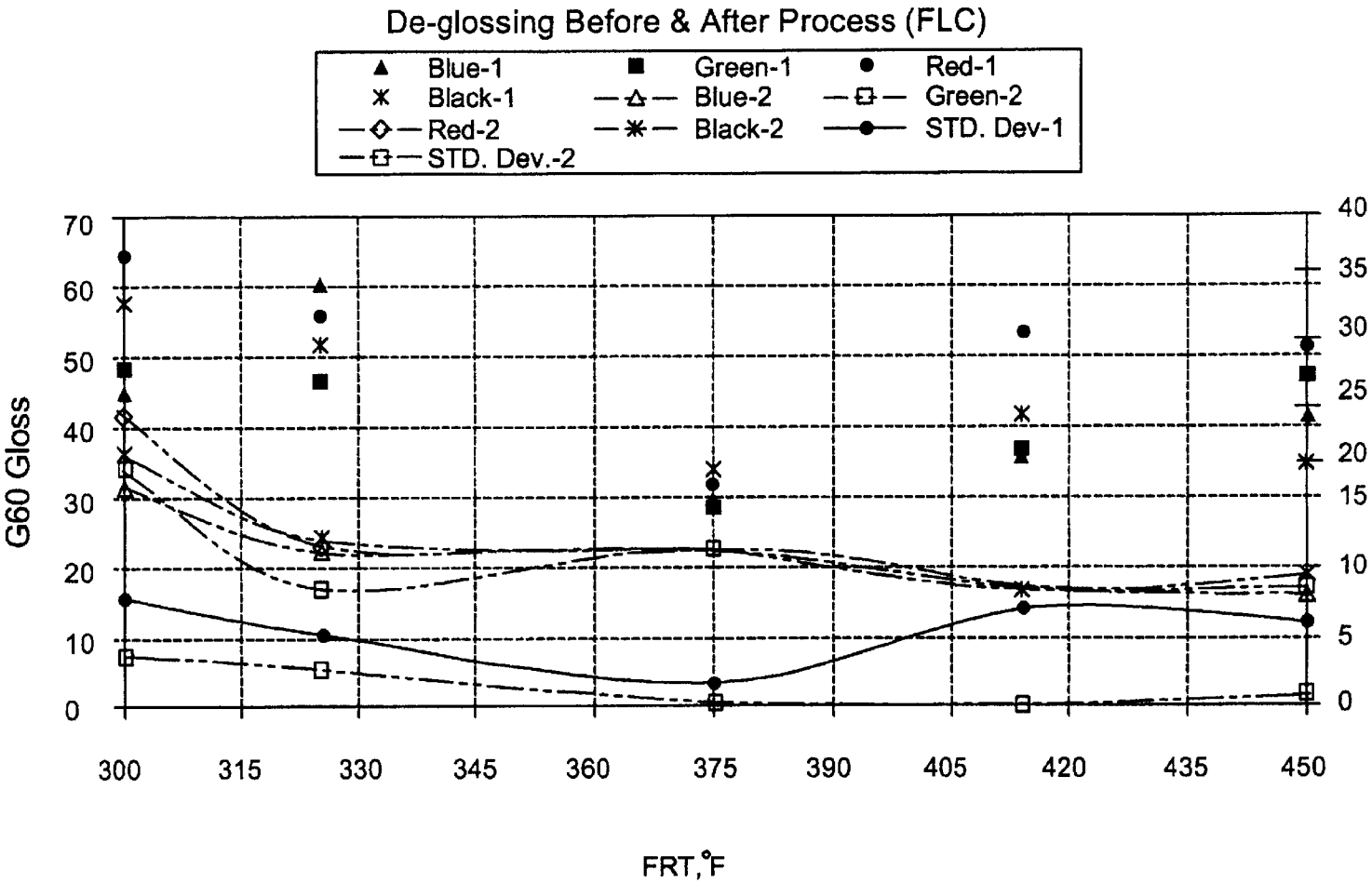
FIG. 4 is a graphical illustration of the Gardner G60 gloss versus finishing temperature for various fused toner images prepared according to Examples 2–6 hereinafter.

As can be seen from the data in FIG. 4 and Table I, the data for Comparative Example A show that the color patches have a differential gloss (i.e., 64.3–44.8) of 19.5 Gardner gloss units prior to treatment in the finishing system. In Example 2, after being passed through the finishing system, the same color patches have a differential gloss (i.e., 41.4–31.5) of 9.9 Gardner gloss units, or a reduction of 49.2% relative to Comparative Example A. A similar comparison of data for the other examples and comparative examples is also shown in Table I; treatment with the finishing system therefore displays a reduction in differential gloss of 48.6% for Example 3, 75.5% for Example 4, 93.8% for Example 5, and 83.7% for Example 6. The reduction in differential gloss is also illustrated by FIG. 4. The reduction in differential gloss results in fused toner images with enhanced image quality. No mottle is observed within the toner images obtained by Examples 2–6.

Further, as can also be seen in FIG. 4, the contact surface of the finishing member can be designed to obtain a desired gloss at energy saturation. Energy saturation is the point where adding more heat energy (i.e., using higher temperature set-points) in the finishing step no long has an effect on toner gloss. At this point, gloss has taken on the texture of the finishing member contact surface material. FIG. 4 shows that, in a temperature range from about 370° F. (187.8° C.) to about 430° F. (221.1° C.), the gloss for each of the color toner patches are in close agreement with each other, and are therefore in a saturated range. After about 370° F. (187.8° C.), there is essentially no drop in gloss as the finishing roller temperature set-point is raised.

In addition, the data illustrated in FIG. 4 also show that the overall gloss for the color patches is reduced by treatment with the finishing roller. This is shown by the gloss values of the patches, after being subjected to treatment in the finishing system, being lower than the gloss of the patches as measured prior to such treatment, in some cases the reduction in overall gloss is significant, such as about 10–20 Gardner G60 gloss units.

COMPARATIVE EXAMPLES F–H

The procedures of Examples 1–6 are substantially repeated for Comparative Examples F–H, except as provided hereinafter. The finishing roller core and base cushion are prepared substantially as in Example 1, except that an outer layer of polytetrafluoroethylene (PTFE) resin is formed onto the base cushion layer, rather than a fluorocarbon thermoplastic random copolymer co-cured with a fluorinated resin.

First, a uniform layer of SILVERSTONE® 855–021 primer (available from E.I. du Pont de Nemours and Company of Wilmington, Del.) of about 0.3 mil in thickness is spray coated onto the EC-4952 polydimethylsiloxane rubber base cushion layer and air-dried. The primer is believed to consist of polyamic acid and polytetrafluoroethylene (PTFE) resin. Thereafter an outer layer of SUPRA SILVERSTONE® 855–500 resin, a blend of PTFE and perfluoroalkoxyvinylether (PFA) fluoropolymer resins also available from DuPont, is then sprayed coated onto the primer layer to a 1.0 mil thickness. The so-coated roller is then placed in a convection oven at 320° C. for approximately 10 minutes to sinter the fluoropolymer resin material to the roller.

A finishing roller (upper roller) having an outer layer of the sintered fluoropolymer resin obtained by the foregoing procedure is thereafter used in the finishing system of the electrostatographic machine substantially according to the procedures described in Examples 2–6, except as provided otherwise hereinafter. The lower finishing roller (pressure roller) employed is a roller with the EC-4952 polydimethylsiloxane rubber base cushion layer thereon.

As in Comparative Examples A–E, the receiver sheets are initially passed through the belt-type fusing system, but not the finishing system incorporating the finishing rollers of the sintered SUPRA SILVERSTONE® fluoropolymer resin and polysiloxane materials described above, to produce a receiver sheet having the same four separate, fused process color toner patches thereon—one each of red, blue, green, and black—having an initial relatively high Gardner gloss value.

As in Comparative Examples A–E, for each run associated with Comparative Examples F–H, the set point temperature for the surface of the fusing belt at the point where the receiver sheet is separated from the belt is adjusted between each run, so that the fused color toner patches obtained in each run will have different, measured initial Gardner gloss values relative to the other runs. The initial G60 values are shown in Table II, and illustrated by FIG. 5.

For Comparative Example F, the procedure of Example 2 is substantially repeated, except that the receivers from Comparative Example F are passed through the finishing system incorporating the sintered SUPRA SILVERSTONE® fluoropolymer resin and polysiloxane rollers described above. The upper roller is also set at a temperature of 325° F. (162.8° C.).

For Comparative Example G, the procedure of Comparative Example F is substantially repeated, except that the receivers from Comparative Example G are passed through the finishing system incorporating the sintered SUPRA SILVERSTONE® fluoropolymer resin and polysiloxane rollers described above. The upper roller is also set at a temperature of 350° F. (176.6° C.).

For Comparative Example H, the procedure of Comparative Example F is substantially repeated, except that the receivers from Comparative Example H are passed through the finishing system incorporating the sintered SUPRA SILVERSTONE® fluoropolymer resin and polysiloxane rollers described above. The upper roller is also set at a temperature of 375° F. (190.6° C.).

After passing the receivers through the finishing system as described above, the G60 value of the fused color toner patches are measured as in Examples 2–6. The data are shown in Table II and also illustrated by FIG. 5.

TABLE II

GLOSS DATA FOR COMPARATIVE EXAMPLES F–H

| Finishing Roller Temp. | G 60 Initial Gloss | | | | | G 60 Final Gloss | | | | |
|---|---|---|---|---|---|---|---|---|---|---|
| (° F.) | Blue | Green | Red | Black | Std. | Blue | Green | Red | Black | Std. |
| 325 | 56.0 | 59.5 | 66.0 | 61.0 | 4.15 | 55.2 | 51.8 | 33.0 | 41.9 | 10.05 |
| 350 | 63.0 | 63.0 | 57.0 | 50.0 | 6.18 | 37.7 | 41.2 | 36.0 | 42.1 | 2.88 |
| 375 | 62.0 | 62.5 | 57.0 | 60.0 | 2.50 | 29.0 | 32.3 | 30.9 | 30.9 | 1.35 |

*Std. means the standard deviation of the gloss data for all four colors at the stated finishing temperature, for either G60 Initial Gloss or G60 Fixed Gloss respectively.

Figure 5:
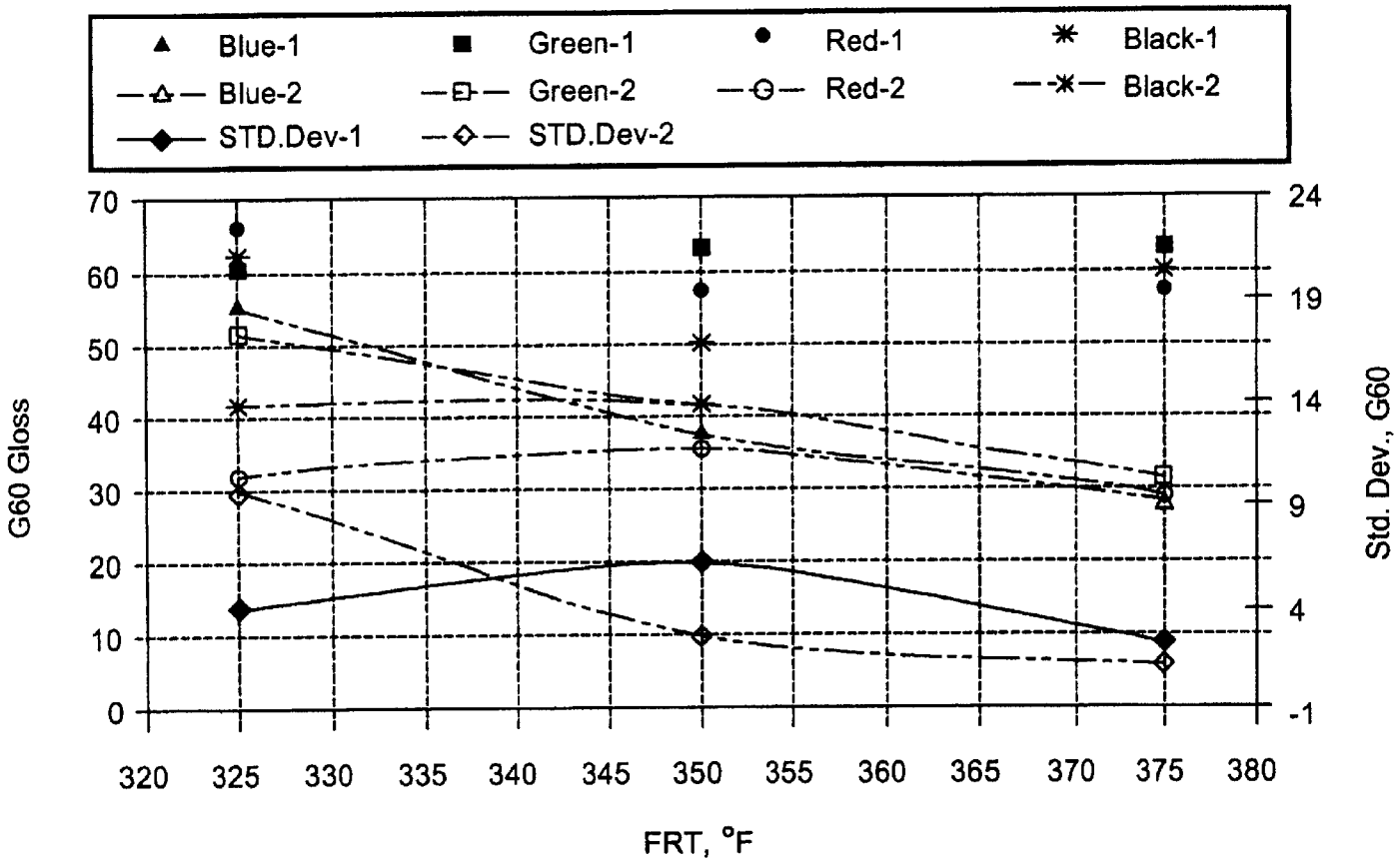
FIG. 5 is a graphical illustration of the Gardner G60 gloss versus temperature for various fused toner images prepared according to Comparative Examples F–H hereinafter.

As can be seen in Table II and FIG. 5, the finishing roller having an outer layer of sintered SUPRA SILVERSTONE® fluoropolymer resin shows some reduction in differential gloss, but not the close agreement in values as seen in FIG. 4. Further, the amount of energy necessary to see some reduction is generally higher than the results obtained for the finishing rollers employed in Examples 2–6, as can be seen by comparing the temperature (355° F.) required to obtain a standard deviation of about 2 for the measured G60 gloss values illustrated on FIG. 4, versus the temperature (about 375° F.) required to obtain the same standard deviation in the gloss values for Comparative Examples F–H illustrated on FIG. 5. The toner images obtained after being passed through the finishing system also contained unacceptable mottle and image artifacts.

Although the present invention has been described in detail with particular reference to the preferred embodiments recited above, it will be understood that variations and modifications can be effected within its scope and spirit.

We claim:

1. Apparatus for adjusting gloss of a toner image fused to a receiver medium, the apparatus comprising:

a finishing member which contacts the toner image on the receiver medium, the finishing member comprising an outer layer having a contact surface thereon comprised of a fluorocarbon thermoplastic random copolymer co-cured with a fluorinated resin, said fluorocarbon thermoplastic random copolymer co-cured with a fluorinated resin being a reaction product of a mixture comprising a fluorocarbon thermoplastic random copolymer, a curing agent having a bisphenol residue, a reactive filler including zinc oxide, a fluorinated resin, and an aminosiloxane;

a pressure member positioned adjacent to and in contact with the outer contact surface of the finishing member such that a pressure nip is formed between the contact surface of the finishing member and the pressure member; and a heat source for transferring heat to at least one of the finishing member and the pressure member so that heat is transferred to the toner image under pressure while the toner image is passed through the pressure nip.

2. The apparatus of claim 1 wherein the fluorocarbon thermoplastic random copolymer co-cured with the fluorinated resin includes subunits of:

$$—(CH_2CF_2)x—,\ —(CF_2CF(CF_3))y—,\ \text{and}\ —(CF_2CF_2)z—,$$

wherein:

x is from 1 to 50 or 60 to 80 mole percent, y is from 10 to 90 mole percent, z is from 10 to 90 mole percent, and x+y+z equals 100 mole percent.

3. The apparatus of claim 1 wherein the finishing member further comprises a core and a base cushion layer overlying the core, the outer layer being disposed over the base cushion layer.

4. The apparatus of claim 1 wherein the pressure member further comprises a second outer layer having a second contact surface thereon comprised of a second fluorocarbon thermoplastic random copolymer co-cured with a second fluorinated resin.

5. The apparatus of claim 4 wherein the second fluorocarbon thermoplastic random copolymer co-cured with the second fluorinated resin is a reaction product of a mixture comprising a second fluorocarbon thermoplastic random copolymer, a second curing agent having a bisphenol residue, a second reactive filler including zinc oxide, a second fluorinated resin, and a second aminosiloxane.

6. The apparatus of claim 4 wherein the second fluorocarbon thermoplastic random copolymer co-cured with the second fluorinated resin includes subunits of:

$$—(CH_2CF_2)i—,\ —(CF_2CF(CF_3))j—,\ \text{and}\ —(CF_2CF_2)k—,$$

wherein:

i is from 1 to 50 or 60 to 80 mole percent, j is from 10 to 90 mole percent, k is from 10 to 90 mole percent, and i+j+k equals 100 mole percent.

7. The apparatus of claim 4 wherein the pressure member further comprises a second core and a second base cushion layer overlying the second core, the second outer layer being disposed over the second base cushion layer.

8. The apparatus of claim 4 wherein the second fluorocarbon thermoplastic random copolymer co-cured with the second fluorinated resin of the pressure member is substantially the same composition as the fluorocarbon thermoplastic random copolymer co-cured with the fluorinated resin of the finishing member.

9. The apparatus of claim 1 wherein the aminosiloxane is an amino functional polydimethyl siloxane copolymer.

10. The apparatus of claim 9 wherein the amino functional polydimethyl siloxane copolymer comprises amino functional units selected from the group consisting of (aminoethylaminopropyl) methyl, (aminopropyl) methyl and (aminopropyl) dimethyl.

11. The apparatus of claim 1 wherein the aminosiloxane has a total concentration of from 1 to 20 parts by weight per 100 parts of the fluorocarbon thermoplastic random copolymer.

12. The apparatus of claim 1 wherein the reactive filler including zinc oxide has a total concentration of from about 1 to about 20 parts by weight per 100 parts of the fluorocarbon thermoplastic random copolymer.

13. The apparatus of claim 1 wherein the reactive filler including zinc oxide has a total concentration in the outer layer of from about 3 to about 15 parts by weight per 100 parts of the fluorocarbon thermoplastic random copolymer.

14. The apparatus of claim 1 wherein the mixture is cured by bisphenol residues.

15. The apparatus of claim 1 wherein the mixture is cured by nucleophilic addition.

16. The apparatus of claim 2 wherein x is from about 30 to about 50 mole percent, y is from about 10 to about 90 mole percent, and z is from about 10 to about 90 mole percent.

17. The apparatus of claim 2 wherein x is from about 40 to about 50 mole percent and y is from about 10 to about 15 mole percent.

18. The apparatus of claim 7 wherein z is greater than about 40 mole percent.

19. The apparatus of claim 1 wherein the fluorinated resin has a number average molecular weight of between about 50,000 and about 50,000,000.

20. The apparatus of claim 1 wherein the amount of fluorinated resin is from about 2 to about 50 weight percent based on the combined weight of the fluorocarbon thermoplastic random copolymer and the fluorinated resin.

21. The apparatus of claim 1 wherein the fluorinated resin is selected from polytetrafluoroethylene, polyfluoroethylenepropylene, or mixtures thereof.

22. The apparatus of claim 3 wherein the base cushion layer comprises a fluoroelastomer.

23. The apparatus of claim 3 wherein the base cushion layer comprises a siloxane elastomer.

24. The apparatus of claim 23 wherein the siloxane elastomer comprises an addition-polymerized reaction product.

25. The apparatus of claim 3 wherein the base cushion layer is from about 3.2 mm to about 6.4 mm thick.

26. The apparatus of claim 3 wherein the base cushion layer has a hardness of from about 20 to about 70 Shore A.

27. The apparatus of claim 1 wherein the outer layer is from about 1 mil to about 4 mils thick.

28. The apparatus of claim 1 wherein the outer layer has a hardness of greater than about 20 Shore A.

29. The apparatus of claim 1 wherein the fluorinated resin has a number average molecular weight of from about 200,000 to about 1,000,000.

30. Apparatus for fusing a toner image to a receiver medium, the apparatus comprising:

a fusing system for fusing the toner image to the receiver medium so as to provide a fused toner image on the receiver medium; and a post-fusing finishing system for adjusting gloss of the fused toner image, the post-fusing finishing system comprising a finishing member which contacts the fused toner image so as to transfer heat thereto under pressure, the finishing member comprising an outer layer having a contact surface thereon including a fluorocarbon thermoplastic random copolymer co-cured with a fluorinated resin, said fluorocarbon thermoplastic random copolymer co-cured with a fluorinated resin being a reaction product of a mixture comprising a fluorocarbon thermoplastic random copolymer, a curing agent having a bisphenol residue, a reactive filler including zinc oxide, a fluorinated resin, and an aminosiloxane.

31. The apparatus of claim 30 wherein the finishing member further comprises a core and a base cushion layer overlying the core, the outer layer being disposed over the base cushion layer.

32. The apparatus of claim 31 wherein the post-fusing finishing system further comprises a pressure member positioned adjacent to and in contact with the contact surface of the finishing member such that a pressure nip is formed between the finishing member and the pressure member.

33. The apparatus of claim 32 wherein the pressure member further comprises a second core, a second base cushion layer overlying the second core, and a second outer layer having a second contact surface thereon overlying the second base cushion layer, the second contact surface including a second fluorocarbon thermoplastic random copolymer co-cured with a second fluorinated resin.

34. The apparatus of claim 33 wherein the second fluorocarbon thermoplastic random copolymer co-cured with the second fluorinated resin of the pressure member is substantially the same composition as the fluorocarbon thermoplastic random copolymer co-cured with the fluorinated resin of the finishing member.

35. A method of fusing a toner image to a receiver medium comprising the steps of:

fusing a thermoplastic toner composition to a receiver medium to provide a fused toner image thereon having an initial amount of gloss; and contacting the fused toner image with a finishing surface comprised of a fluorocarbon thermoplastic random copolymer co-cured with a fluorinated resin, the contact being under conditions of temperature and pressure such that gloss of the fused toner image is adjusted thereby.

36. The method of claim 35 wherein the fused toner image has an initial overall G60 gloss of at least about 10.

37. The method of claim 35 wherein the fused toner image has an initial overall G60 gloss of from about 20 to about 70.

38. The method of claim 35 wherein the fused toner image has an initial differential gloss, prior to contacting the finishing surface, of at least about 5 Gardner G60 gloss units.

39. The method of claim 38 wherein after contact with the finishing surface, the fused toner image has a differential gloss reduction of at least about 20%.

40. The method of claim 38 wherein after contact with the finishing surface, the fused toner image has a differential gloss reduction of at least about 80%.

41. The method of claim 38 wherein after contact with the finishing surface, the fused toner image has a differential gloss reduction of at least about 90%.

42. The method of claim 37 wherein after contact with the finishing surface, the fused toner image has an adjustment in overall gloss of at least about ±5 Gardner G60 gloss units.

43. The method of claim 35 wherein the thennoplastic toner composition comprises a process color toner set having a cyan toner, a magenta toner, and a yellow toner.

44. The method of claim 43 wherein the process color toner set further includes a black toner.

45. The method of claim 35 wherein the temperature of contact is from about 150° C. to about 230° C.

46. The method of claim 35 wherein the pressure of contact is from about 20 to about 120 pounds per square inch (psi).

47. The method of claim 35 wherein the gloss adjusted is differential gloss.

48. The method of claim 36 wherein the gloss adjusted is overall gloss.

49. A method for adjusting gloss of a fused toner image having an initial amount of gloss and comprising a thermoplastic toner composition, the method comprising contacting the fused toner image with a finishing surface comprised of a fluorocarbon thermoplastic random copolymer co-cured with a fluorinated resin, the contact being under conditions of temperature and pressure such that gloss of the fused toner image is adjusted thereby.

50. The method of claim 49 wherein the gloss adjusted is differential gloss.

51. The method of claim 49 wherein the gloss adjusted is overall gloss.

52. The method of claim 51 wherein the fused toner image has an initial overall G60 gloss of at least about 10.

53. The method of claim 51 wherein the fused toner image has an initial overall G60 gloss of from about 20 to about 70.

54. The method of claim 50 wherein the fused toner image has an initial differential gloss, prior to contacting the finishing surface, of at least about 5 Gardner G60 gloss units.

55. The method of claim 54 wherein after contact with the finishing surface, the fused toner image has a differential gloss reduction of at least about 20%.

56. The method of claim 54 wherein after contact with the finishing surface, the fused toner image has a differential gloss reduction of at least about 80%.

57. The method of claim 53 wherein after contact with the finishing surface, the fused toner image has an adjustment in overall gloss of at least about ±5 Gardner G60 gloss units.

58. The method of claim 49 wherein the thermoplastic toner composition comprises a process color toner set having a cyan toner, a magenta toner, and a yellow toner.

59. The method of claim 58 wherein the process color toner set further includes a black toner.

60. The method of claim 49 wherein the temperature of contact is from about 150° C. to about 230° C.

61. The method of claim 49 wherein the pressure of contact is from about 20 to about 120 pounds per square inch (psi).

* * * * *